United States Patent [19]

Matzner

[11] 4,295,502

[45] Oct. 20, 1981

[54] METHOD AND APPARATUS FOR THE ELIMINATION OF FOAM ABOVE THE LEVEL OF A LIQUID, AND PARTICULARLY ABOVE A PACKAGED LIQUID SUCH AS MILK

[75] Inventor: Erwin Matzner, Krefeld, Fed. Rep. of Germany

[73] Assignee: Jagenberg Werke AG, Dusseldorf, Fed. Rep. of Germany

[21] Appl. No.: 87,358

[22] Filed: Oct. 23, 1979

[30] Foreign Application Priority Data

Jul. 4, 1979 [DE] Fed. Rep. of Germany ..... 2926955

[51] Int. Cl.[3] ..... B65B 3/04

[52] U.S. Cl. ..... 141/11; 141/69; 141/286; 210/748; 250/432 R

[58] Field of Search ..... 141/11, 69, 70, 285, 141/286, 392, 1-10, 12; 310/322; 250/492 R, 432 R, 304; 210/748

[56] References Cited

U.S. PATENT DOCUMENTS

| | | | |
|---|---|---|---|
| 2,896,922 | 7/1959 | Pohlman | 210/748 |
| 3,266,631 | 8/1966 | Snaper | 210/748 |
| 3,503,804 | 3/1970 | Schneider | 210/748 |
| 4,032,438 | 6/1977 | Koblanski | 210/748 |
| 4,076,617 | 2/1978 | Bybel et al. | 210/748 |
| 4,121,107 | 10/1978 | Bachmann | 250/492 R |
| 4,230,947 | 10/1980 | Cram | 250/432 R |

*Primary Examiner*—Houston S. Bell, Jr.
*Attorney, Agent, or Firm*—Sprung, Felfe, Horn, Lynch & Kramer

[57] ABSTRACT

A method and an apparatus for the elimination of foam above the level of the liquid in a container. The foam is collapsed by the application of high frequency wave radiation thereto.

20 Claims, 4 Drawing Figures

METHOD AND APPARATUS FOR THE ELIMINATION OF FOAM ABOVE THE LEVEL OF A LIQUID, AND PARTICULARLY ABOVE A PACKAGED LIQUID SUCH AS MILK

BACKGROUND OF THE INVENTION

The invention relates to a method for elimination of foam above the level of a liquid, and particularly above the liquid content of a container filled with, for example, milk. The invention further relates to an apparatus for carrying out said method.

In many industrial areas it is desirable to avoid foam formation above the level of a liquid or to destroy foam which has formed. This is the case in flotation, for example, or in the evaporation of liquids, where foam located above the liquid level interferes with transportation and evaporation. The present invention is concerned specifically with the elimination of foam forming above the liquid level of containers which are being filled with liquids such as milk or fruit juices and which are then to be closed. Such foam, formed either during and/or as a result of the filling operation, is troublesome especially when containers fabricated from plastics-coated paperboard are being filled which are then closed at the top by heat sealing or bonding. When there is foam between the surfaces to be adhered, a proper bond cannot be secured in the areas so wetted, and the container so closed is not adequately sealed. With heat sealing, it is possible to bond the surfaces to be sealed since the heat generated and the pressure exerted by the sealing jaws will evaporate and/or squeeze off the foam film present. However, the protein residue remaining on the surfaces to be sealed will impair the seal. A foam film is particularly deleterious in a heat-sealing operation which involves preheating (activating) of a thermoplastic coating forming the surfaces to be sealed, followed by a pressing together of these surfaces by means of cold pressure jaws to form the seal. The wet foam will cool the preheated sealing surfaces in places so that in the pressing operation which follows a dependable bond, and hence an effective closure, is not secured.

A further drawback is that as the container is closed, as by folding of the top of a folding container, the foam over the liquid level overflows and fouls both the outside of the container and the sealing implements.

Since for reasons of economy the containers are not sized substantially larger than as required for accommodation of the contents, it is necessary in the cooling of milk, for example, in filling plants to provide a separate means for elimination of the foam over the milk if the drawbacks described are to be avoided. This means comprises a short suction pipe adapted to be introduced into the container to be sealed, and a suction system whereby the foam over the liquid level is removed. Moreover, to assure a satisfactory closure, blast nozzles are provided for blowing the drops and residual foam from the surfaces to be sealed or bonded.

This known foam-elimination method is afflicted with several drawbacks. In the first place, the milk sucked up as foam, which represents a substantial amount, cannot be reused to fill containers but can be used only as livestock feed. This amounts to a loss of milk to be packaged. Moreover, the tendency to foam in being packaged varies from one liquid to another and in the case of milk depends on its condition (raw milk or homogenized milk) and on its fat content, on the temperature, and on the rate at which the containers are filled with it. In fact, foaming may differ from one container to the next. As a result, the extent to which the container is filled with milk varies with the amount of foam drawn off. Finally, in the packaging of sterile liquids, such as sterilized milk, the drawing off of foam may render it difficult to maintain sterile conditions. The suction pipe comes in contact with the foam and therefore must be kept clean and inspected frequently if contamination with microorganisms is to be prevented.

SUMMARY OF THE INVENTION

Against this background, the invention has as its object to provide a method and an apparatus whereby foam can be eliminated by simple means, particularly in the filling of containers, and without loss of liquid.

In accordance with the invention, this object is accomplished in that the foam is destroyed by the action of high-frequency wave radiation.

The invention is based on the fact that foam can be collapsed in place by subjecting the foam structure to high-frequency wave radiation. The portion of liquid forming the foam then again becomes part of the liquid content of the container, rather than being wasted, as is the case with the prior-art methods outlined above.

It has been found that foam can be effectively destroyed by the action of both electromagnetic waves, such as microwaves or infrared radiation, and pressure waves such as sound. It will be appreciated that the term "high-frequency" is susceptible of being interpreted in different ways, depending on the nature of the wave radiation involved. In the case of microwave radiation, for example, it refers to the frequency range from 0.3 to 300 GHz. In infrared radiation with its still shorter wavelengths, the frequency is correspondingly higher. In the case of sound waves, of which primarily those above the sonic range are suited for use with the invention, the high-fequency range is in the neighborhood of 20,000 Hz.

The radiation, for example, the ultrasonic radiation, is advantageously directed against the liquid level. This not only results in the suppression of undesirable reactions outside the foamed area but also in a concentration of the radiation of the foam structure. It has been found that particularly good results are obtained in the destruction of foam when a plurality of overlapping ultrasonic wave fields extending in substantially the same direction are caused to act on the foam structure. For example, when eight parallel ultrasonic wave fields are radiated into the foam structure by an appropriately designed horn or sonotrode, then after an exposure time of just 0.2 to 0.3 seconds the foam will be destroyed to an extent not usually attainable by the suction arrangement described.

The invention lends itself particularly well to the packaging of sterile liquids since in addition to offering the advantages outlined it makes it easy to maintain aseptic conditions. The device emitting the wave radiation, for example, the directional microwave radiator or the sonotrode for ultrasonic waves, need not be immersed in the foam structure but may be located above the anticipated foam layer. In all cases there is only an electrical cable leading to that device so that even a breakdown or shutdown will have no adverse effect on the sterile environment.

It is of advantage to radiate the ultrasonic waves into the foam structure with as large an amplitude of oscillation of the sonotrode as possible, for example, up to 60μ, since the time required for the destruction of the foam can then be substantially reduced. This is of importance when an ultrasonic generator associated with the apparatus energizes both a sonotrode for destruction of the foam and sealing jaws for closing the containers. With the foam-destruction time shortened, both foam destruction and sealing, after changeover at the ultrasonic generator, can be accomplished within one cycle time.

The apparatus for carrying out the method in accordance with the invention comprises a means, disposed above and spaced from the liquid level, for radiating high-frequency energy, such as a directional microwave radiator, an infrared radiator, or a sonotrode for ultrasonic waves. This means may be stationary or it may be adapted to be raised and lowered over the liquid level.

When sonotrodes are used for the radiation of ultrasonic waves, it is advantageous to combine a plurality of sonotrodes into a bank of sonotrodes or into an aggregate sonotrode. The individual sonotrodes are advantageously constructed as pins and arranged parallel to one another on a metal block to permit them to radiate the individual ultrasonic wave fields side by side and close together into the foam. In order that the foam layer over the liquid may be fully covered even by a focused radiation field, it is advisable to adapt the means for radiation of the waves, for example, the sonotrode, to the cross-sectional configuration of the container in the area of the liquid level.

BRIEF DESCRIPTION OF THE DRAWINGS

The invention will now be described in greater detail with reference to an embodiment shown diagrammatically in the accompanying drawing, wherein.

DETAILED DESCRIPTION OF THE DRAWINGS

Figure 1:
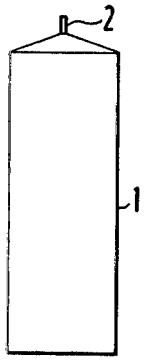
FIG. 1 is a side elevation of a container intended to hold a liquid such as milk.

The container 1 shown in FIG. 1, which is to hold a liquid such as milk, is conventionally fabricated from plastics-coated paperboard. It is of rectangular or square cross section and in the closed condition is folded at the top to form a peak and there is closed along a sealing fillet 2 by heat sealing of the plastics coating.

Figure 2:
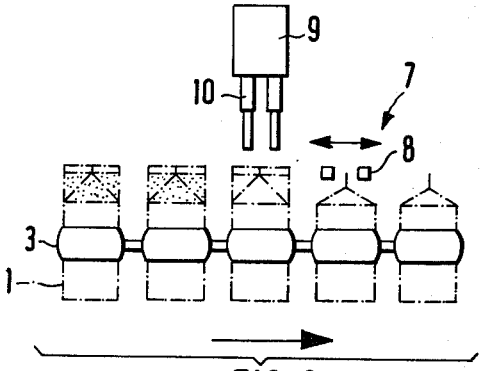
FIG. 2 is a diagrammatic representation of a conveying means for containers according to FIG. 1, filled with liquid but still unsealed, and of a means for destruction of the foam.

FIG. 2 shows diagrammatically how containers 1 according to FIG. 1, filled with a liquid such as milk, are conveyed. The containers are carried on a conveyor in the form of a cellular chain 3, with every cell holding a container 1 and securing it against toppling over. The cellular chain 3 moves the containers 1 in the direction indicated by the arrow. In a preceding filling station (not shown) the then empty containers are filled with liquid. Depending on the foaming tendency of the liquid, there forms above the liquid level 4 (see FIG. 4), during and as a result of the filling operation, a foam layer 5 of varying thickness which extends as far as the area of the heat-sealing surfaces 6 to be bonded together to form the sealing fillet 2. In FIG. 2 the foam layer 5 indicated by dots.

The cellular chain 3 conveys the containers 1 to a heat-sealing station consisting only of the sealing jaws 8, shown diagrammatically. The sealing jaws 8 execute a tongs-like opening and closing motion and are further adapted to be raised and lowered by means which are not shown. They are either energized by ultrasonic energy, in which case they constitute an ultrasonic sonotrode, or are heatable. In the closed condition, in which they press the heat-sealing surfaces 6 of the container 1 together, they apply sufficient heat to the plastics coating in the area of the heat-sealing surfaces 6 for the latter to become welded together by the action of pressure and heat. Heat-sealing jaws of this type are known in the art and therefore need not be described in detail.

Ahead of the heat-sealing station 7 in the direction of travel, and following several "free stations" after the filling station (not shown), the sonotrode 9 comprising a bank of eight individual sonotrodes 10 is fixedly disposed above the cellular chain 3. The tips of the individual sonotrodes 10 are located just above the top of the containers 1.

Figure 3:
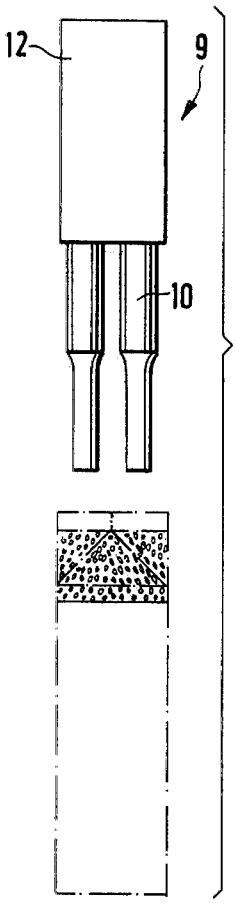
FIGS. 3 and 4 are side elevations in the longitudinal and transverse directions of a sonotrode for generation of ultrasonic wave fields, the disposition relative to the sonotrode of a container according to FIG. 1 also being shown.
Figure 4:
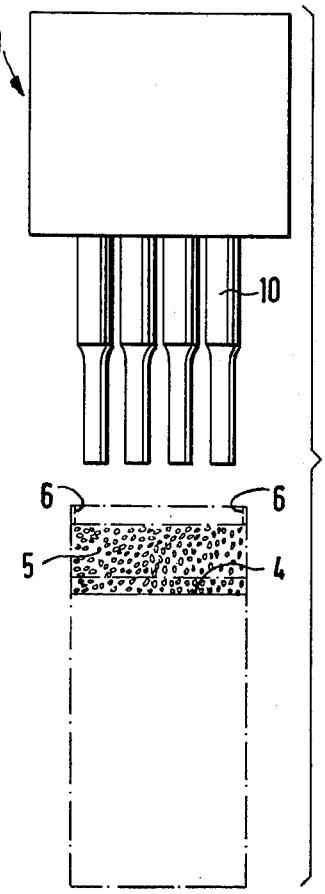

The sonotrode 9 with the individual sonotrodes 10 is shown on an enlarged scale in FIGS. 3 and 4. It is apparent that a bank of eight pinlike individual sonotrodes 10 is attached to the underside of a rectangular aluminum block 12. The individual sonotrodes 10 are made of titanium and are reduced in diameter from a point about halfway down their length so that at their lower end they are thinner than at the point where they are attached to the aluminum block 12. The individual sonotrodes 10 are distributed over the underside of the aluminum block 12 in such a way that they approximately cover the cross-sectional area of the container both lengthwise and widthwise. (See FIG. 4) The aluminum block 12 is connected, in a manner which is not shown, to a booster of the ultrasonic system, to an associated converter, and to an ultrasonic generator. The basic design of an ultrasonic system of this type is also known in the art and need not be described in detail. Supersonic energy is applied to the aluminum block 12 and the individual sonotrodes 10 attached thereto at a frequency of 20,000 Hz and a sufficiently high level to obtain at the individual sonotrodes 10 an amplitude of oscillation of about 60μ. This causes eight approximately equidirectional ultrasonic wave fields to be radiated from the tips of the individual sonotrodes 10 in the direction of the liquid level 4 in the container 1, which penetrate into the foam structure and destroy it. In the case of milk, for example, an exposure time of 0.2 seconds will suffice to completely destroy a foam layer of a height of 7.5 cm above the content of the container.

Solely by way of example, it might be stated that the aluminum block 12 is 60 mm wide, 150 mm long and 124 mm high while the individual sonotrodes 10 are 23 mm in diameter in their thicker section and 16 mm in diameter in their thinner section.

The number of individual sonotrodes need not be the same as in the embodiment. However, it has been found that as the number of individual sonotrodes is increased, the destructive effect on the foam structure is intensified, with the result that the time required to collapse the foam is reduced. Nor is it necessary that the sonotrodes be arranged in a rectangular pattern as in the embodiment, where the individual sonotrodes 10 are distributed in pairs and equally spaced over the underside of the aluminum block 12, although it is advisable in order that at all points of the foam structure equal overlapping of the ultrasonic wave fields, and hence a uniform effect, be secured.

It will be appreciated that the instant specification and claims are set forth by way of illustration and not limitation, and that various changes and modifications may be made without departing from the spirit and scope of the present invention.

What is claimed is:

1. A method for the elimination of foam above the level of a liquid in a container comprising collapsing the foam by applying ultrasonic waves to the foam indirectly through the ambient atmosphere.

2. A method according to claim 1, wherein the waves are directed from above and toward the liquid level.

3. A method according to claim 1, wherein the liquid is introduced into the containers within a cycle time determined by a filling machine and the time of exposure to the ultrasonic waves is only a fraction of the cycle time.

4. A method according to claim 1 or claim 3, wherein a plurality of overlapping and approximately equidirectional ultrasonic wave fields are applied to the foam.

5. A method according to claim 4, wherein eight indentical ultrasonic wave fields are radiated side by side to act on the foam.

6. A method according to claim 1, wherein the ultrasonic waves are radiated with as large an amplitude of oscillation as possible.

7. An apparatus for the elimination of foam above the level of a liquid in a container, comprising means for applying ultrasonic waves indirectly to the foam through the ambient atmosphere to collapse same and means for positioning the ultrasonic means above the liquid level and spaced therefrom.

8. An apparatus according to claim 7, wherein said ultrasonic means comprises an ultrasonic horn.

9. An apparatus according to claim 7, wherein the means for positioning ultrasonic means disposes same above the liquid level and spaced therefrom by at least the anticipated thickness of the foam layer.

10. An apparatus according to claim 8, wherein the raidation means comprises a plurality of horns, forming a horn bank.

11. An apparatus according to claim 10, wherein the individual horns are of pinlike construction and are mounted parallel to one another on a metallic block.

12. An apparatus according to claim 10 or claim 11, wherein the individual horns are of circular cross section and are reduced in diameter toward their free end in the longitudinal direction.

13. An apparatus according to claim 12, wherein the free ends of the individual horns are all at the same level.

14. An apparatus according to claim 12, wherein the individual horns are rounded in the region of transition from the larger to the smaller diameter.

15. An apparatus according to claim 11, wherein horns are uniformly distributed over the underside of the metallic block.

16. An apparatus according to claim 7, wherein the means for applying ultrasonic waves is adapted to the cross-sectional configuration of the container in the area of the liquid level.

17. An apparatus according to claim 7, wherein the means for positioning the ultrasonic means includes means for raising and lowering it above the liquid level.

18. An apparatus according to claim 7, wherein the ultrasonic means is disposed in a filling machine immediately following a filling station for containers.

19. A method for eliminating foam above the level of a liquid in a container comprising collapsing the foam by applying one of infrared and microwave radiation to the foam indirectly through the ambient atmosphere.

20. An apparatus for eliminating foam above the level of a liquid in a container comprising means for applying one of infrared and microwave radiation to the foam indirectly through the ambient atmosphere to collapse the foam and means positioning the radiation applying means above the liquid level and spaced apart therefrom.

* * * * *